US008925854B2

(12) United States Patent
Chen et al.

(10) Patent No.: US 8,925,854 B2
(45) Date of Patent: Jan. 6, 2015

(54) PAPER ROLL FIXING DEVICE OF PRINTER

(71) Applicant: Primax Electronics Ltd., Neihu, Taipei (TW)

(72) Inventors: Yi-Liang Chen, Taipei (TW); Wen-Hsien Yen, Taipei (TW)

(73) Assignee: Primax Electronics Ltd., Neihu (TW)

( * ) Notice: Subject to any disclaimer, the term of this patent is extended or adjusted under 35 U.S.C. 154(b) by 158 days.

(21) Appl. No.: 13/737,533

(22) Filed: Jan. 9, 2013

(65) Prior Publication Data

US 2014/0027561 A1 Jan. 30, 2014

(30) Foreign Application Priority Data

Jul. 27, 2012 (TW) ..... 101127146 A

(51) Int. Cl.
*B65H 75/24* (2006.01)
*B65H 16/06* (2006.01)

(52) U.S. Cl.
CPC ..... *B65H 16/06* (2013.01)
USPC ..... 242/578.1; 242/596.1

(58) Field of Classification Search
CPC ..... B65H 16/06; B65H 2301/41346; B65H 2402/441; B65H 2511/12; B65H 2403/411; B65H 2220/04
USPC ..... 242/578, 578.1–578.3, 596, 242/596.1–596.3
See application file for complete search history.

(56) References Cited

U.S. PATENT DOCUMENTS

| | | | | | |
|---|---|---|---|---|---|
| 2,905,404 | A * | 9/1959 | Simmons | 242/423.2 |
| 3,411,734 | A * | 11/1968 | Greenberg et al. | 242/578.2 |
| 5,813,343 | A * | 9/1998 | Harb | 101/407.1 |
| 6,431,492 | B1 * | 8/2002 | Chillscyzn | 242/577 |
| 6,561,453 | B1 * | 5/2003 | Shinga | 242/595.1 |
| 6,695,500 | B2 * | 2/2004 | Kim et al. | 400/613 |
| 7,381,002 | B2 * | 6/2008 | Sugimoto et al. | 400/613 |
| 8,047,462 | B2 * | 11/2011 | Yamada | 242/578 |
| 8,500,058 | B2 * | 8/2013 | Lan | 242/578 |
| 2009/0114758 | A1 * | 5/2009 | Yamada | 242/566 |

* cited by examiner

*Primary Examiner* — William A Rivera
(74) *Attorney, Agent, or Firm* — Kirton McConkie; Evan R. Witt

(57) ABSTRACT

A paper roll fixing device of a printer is provided. The paper roll fixing device includes a first supporting member and a second supporting member. The first supporting member includes a first supporting protrusion part and plural first auxiliary rollers. The second supporting member includes a second supporting protrusion part and plural second auxiliary rollers. The first supporting protrusion part and the second supporting protrusion part are inserted into two ends of a hollow shaft of a paper roll. Consequently, the paper roll is fixed in the space between the first supporting member and the second supporting member, and supported by the first auxiliary rollers and the second auxiliary rollers. Moreover, especially, the paper roll fixing device is applicable to a variety of paper rolls with different diameters.

7 Claims, 15 Drawing Sheets

PAPER ROLL FIXING DEVICE OF PRINTER

FIELD OF THE INVENTION

The present invention relates to a paper roll fixing device, and more particularly to a paper roll fixing device of a printer.

BACKGROUND OF THE INVENTION

In the markets, many conventional printers (e.g. label printers) use paper rolls as print media. Generally, a paper roll of the label printer comprises a hollow shaft and a paper tape wound on the hollow shaft. The paper tape comprises a laminated film strip and plural label papers. The label papers are discretely attached on the laminated film strip at regular intervals. During the printing task is performed, the paper tape is driven to be moved through a printing mechanism, and the label papers are printed by the printing mechanism. Moreover, during the printing task is performed, the label papers are successively outputted from the label printer. Correspondingly, the paper roll is rotated, and thus the overall diameter of the paper roll is gradually decreased. If the paper roll is moved up and down or shifted left and right upon rotation of the paper roll, the rotating and printing smoothness are impaired. For enhancing the rotating and printing smoothness, a fixing structure or a supporting structure is installed within the label printer for preventing the paper roll from being moved up and down or shifted left and right upon rotation of the paper roll.

FIG. 1 is a schematic exploded view illustrating a conventional label printer. The components of the conventional label printer 1 will be illustrated as follows. As shown in FIG. 1, the conventional label printer 1 comprises a paper roll fixing device 11 and a casing 12. The paper roll fixing device 11 is disposed within the casing 12.

The paper roll fixing device 11 comprises a first supporting member 111, a second supporting member 112, a first movable track 113, a second movable track 114, and a rotating wheel 115. The first supporting member 111 comprises a first supporting protrusion part 111*a*. The second supporting member 112 comprises a second supporting protrusion part (not shown). The second supporting protrusion part has the same structure as the first supporting protrusion part 111*a*.

Moreover, the first supporting protrusion part 111*a* comprises a first ring-shaped structure 111*aa*, a second ring-shaped structure 111*ab* and a third ring-shaped structure 111*ac*, which have different outer circumferences. The second supporting protrusion part comprises a fourth ring-shaped structure, a fifth ring-shaped structure and a sixth ring-shaped structure (not shown). The outer circumferences of the fourth ring-shaped structure, the fifth ring-shaped structure and the sixth ring-shaped structure are identical to the outer circumferences of the first ring-shaped structure 111*aa*, the second ring-shaped structure 111*ab* and the third ring-shaped structure 111*ac*, respectively. The outer circumference of the first ring-shaped structure 111*aa* is smaller than the outer circumference of the second ring-shaped structure 111*ab*. The outer circumference of the second ring-shaped structure 111*ab* is smaller than the outer circumference of the third ring-shaped structure 111*ac*.

Hereinafter, a sequence of assembling the conventional label printer 1 will be illustrated with reference to FIG. 1. Firstly, an end 113*a* of the first movable track 113 is connected with the first supporting member 111, and an end 114*a* of the second movable track 114 is connected with the second supporting member 112. Then, the first movable track 113 and the second movable track 114 are parallel with each other, and the rotating wheel 115 is clamped between and engaged with the first movable track 113 and the second movable track 114.

In addition, the first supporting member 111 and the second supporting member 112 are parallel with each other, and the first supporting protrusion part 111*a* and the second supporting protrusion part face each other.

The operations of the conventional label printer 1 will be illustrated in more details as follows. Please refer to FIG. 1 again. As mentioned above, the paper roll comprises a hollow shaft and a paper tape wound on the hollow shaft. For installing the paper roll within the label printer 1, the first supporting member 111 or the second supporting member 112 is firstly pulled. Through the rotating wheel 115, the first movable track 113 and the second movable track 114 may be linearly moved. Consequently, the first supporting member 111 and the second supporting member 112 are distant from each other. Then, a first end of the hollow shaft of the paper roll is fixed by the first supporting protrusion part 111*a* of the first supporting member 111.

Then, the second supporting member 112 is moved. During the process of moving the second supporting member 112, the first supporting member 111 and the second supporting member 112 are moved toward each other through the rotating wheel 115. Until a second end of the hollow shaft of the paper roll is fixed by the second supporting protrusion part of the second supporting member 112, the paper roll is fixed within the label printer 1.

If the inner circumference of the hollow shaft is equal to the outer circumference of the first ring-shaped structure 111*aa*, the first ring-shaped structure 111*aa* is inserted into the first end of the hollow shaft of the paper roll, and the fourth ring-shaped structure is inserted into the second end of the hollow shaft of the paper roll. In addition, the first ring-shaped structure 111 as and the fourth ring-shaped structure are contacted with the inner peripheries of the hollow shaft of the paper roll in order to fix the position of the paper roll.

Similarly, if the inner circumference of the hollow shaft is equal to the outer circumference of the second ring-shaped structure 111*ab*, the second ring-shaped structure 111*ab* and the fifth ring-shaped structure are respectively inserted into the first end and the second end of the hollow shaft of the paper roll. Similarly, if the inner circumference of the hollow shaft is equal to the outer circumference of the third ring-shaped structure 111*ac*, the third ring-shaped structure 111*ac* and the sixth ring-shaped structure are respectively inserted into the first end and the second end of the hollow shaft of the paper roll.

From the above discussions, the ring-shaped structures of the conventional label printer 1 are inserted into the two ends of the hollow shaft of the paper roll, so that the position of the paper roll is fixed.

However, the conventional label printer 1 still has some drawbacks. The inner circumferences of the hollow shafts of the paper rolls from different factories may be different. Regardless of the inner circumferences of the hollow shafts, the widths of these paper rolls are identical. In a case that the paper roll fixing device is equipped with plural ring-shaped structures matching all paper roll specifications, the paper roll fixing device may occupy much space and thus the volume of the casing will be very large.

In a case that the plural ring-shaped structures only match some paper roll specifications, the applications of the paper roll fixing device are restricted. For example, if the inner circumference of the hollow shaft of the paper roll is greater than the largest outer circumference of the plural ring-shaped structures, the paper roll is moved downwardly in response to the gravity force thereof. Under this circumstance, the casing 12 is pressed by the bottom of the paper roll.

In other words, although the paper roll is not shifted left and right during the printing task is performed, the paper tape is readily rubbed against the casing 12 upon the rotation of the paper roll. Consequently, the paper tape fails to be smoothly moved, and the possibility of abrading or stripping the label papers is increased.

Therefore, there is a need of providing an improved paper roll fixing device of a label printer in order to eliminate the above problems.

SUMMARY OF THE INVENTION

The present invention provides a paper roll fixing device of a printer applicable to a variety of paper rolls that comply with different paper roll specifications.

In accordance with an aspect of the present invention, there is provided a paper roll fixing device of a printer for fixing a paper roll within the printer. The paper roll has a hollow shaft. The paper roll fixing device includes a first supporting member and a second supporting member. The first supporting member includes a first supporting protrusion part and plural first auxiliary rollers. The plural first auxiliary rollers are discretely arranged near a bottom edge of the first supporting member and located below the first supporting protrusion part. The second supporting member is parallel with the first supporting member, and includes a second supporting protrusion part and plural second auxiliary rollers. The plural second auxiliary rollers are discretely arranged near a bottom edge of the second supporting member and located below the second supporting protrusion part. The first supporting protrusion part is inserted into the hollow shaft from a first end of the paper roll, and the second supporting protrusion part is inserted into the hollow shaft from a second end of the paper roll, so that the paper roll is fixed within a space between the first supporting member and the second supporting member. Moreover, the plural first auxiliary rollers and the plural second auxiliary rollers are pressed by two ends of an outer surface of the paper roll, respectively.

In an embodiment, the first supporting member further includes a first bottom plate. The first bottom plate is vertically extended from a bottom edge of a first inner surface of the first supporting member. Moreover, the plural first auxiliary rollers are discretely arranged on the first bottom plate.

In an embodiment, the second supporting member further includes a second bottom plate. The second bottom plate is vertically extended from a bottom edge of a second inner surface of the second supporting member. Moreover, the plural second auxiliary rollers are discretely arranged on the second bottom plate.

In an embodiment, the paper roll fixing device further includes a rotating wheel, a first movable track, and a second movable track. The first movable track is connected with the first supporting member, and engaged with the rotating wheel. The second movable track is parallel with the first movable track, connected with the second supporting member, and engaged with the rotating wheel. The first movable track and the second movable track are linearly moved back and forth in a reciprocating manner through the rotating wheel, so that a distance between the first supporting member and the second supporting member is adjustable.

In an embodiment, the first supporting protrusion part is protruded from the first inner surface and includes a first bump and a second bump. The first bump is disposed over the second bump. The second supporting protrusion part is protruded from the second inner surface and includes a third bump and a fourth bump. The third bump is disposed over the fourth bump.

In an embodiment, the first supporting member further includes a first through-hole, a first shaft, a first fixing slab, a first elastic element, and a first propping sheet. The first through-hole is formed in the first supporting member. The first shaft is disposed on a first outer surface of the first supporting member. The first fixing slab is pivotally coupled with the first shaft, and disposed within the first through-hole. The first elastic element is located over the first shaft and connected with a first end of the first fixing slab. The first propping sheet is disposed within the first through-hole and located under the first fixing slab. The first bump is disposed on the first fixing slab, and the second bump is disposed on the first propping sheet. Through the first elastic element, the first bump on the first fixing slab is not protruded outside the first inner surface of the first supporting member, but a second end of the first fixing slab is protruded outside the first inner surface of the first supporting member.

In an embodiment, the second supporting member further includes a second through-hole, a second shaft, a second fixing slab, a second elastic element, and a second propping sheet. The second through-hole is formed in the second supporting member. The second shaft is disposed on a second outer surface of the second supporting member. The second fixing slab is pivotally coupled with the second shaft, and disposed within the second through-hole. The second elastic element is located over the second shaft and connected with a first end of the second fixing slab. The second propping sheet is disposed within the second through-hole and located under the second fixing slab. The third bump is disposed on the second fixing slab, and the fourth bump is disposed on the second propping sheet. Through the second elastic element, the third bump on the second fixing slab is not protruded outside the second inner surface of the second supporting member, but a second end of the second fixing slab is protruded outside the second inner surface of the second supporting member.

In an embodiment, the first propping sheet and the second propping sheet are made of flexible materials.

In an embodiment, each of the second bump and the fourth bump includes two slant surfaces for guiding the paper roll to be introduced into or removed from the space between the first supporting member and the second supporting member.

In an embodiment, both of the first supporting protrusion part and the second supporting protrusion part are ring-shaped bumps or cylindrical bumps.

In an embodiment, the first supporting member further includes a perforation and a locking member. The printer further includes plural second toothed structures therein. The locking member is disposed within the perforation and has plural first toothed structures. The plural first toothed structures and the plural second toothed structures are engaged with each other for fixing the first supporting member.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

The present invention provides a paper roll fixing device of a printer (e.g. a label printer).

In the following first, second and third embodiments of the present invention, the paper roll fixing device is equipped with three first auxiliary rollers and three second auxiliary rollers. It is noted that the numbers of the first auxiliary rollers and the second auxiliary rollers are presented herein for purpose of illustration and description only. The numbers of the first auxiliary rollers and the second auxiliary rollers are not restricted as long as plural first auxiliary rollers and plural second auxiliary rollers are respectively disposed on a first supporting member and a second supporting member for supporting the paper roll.

Figure 1:
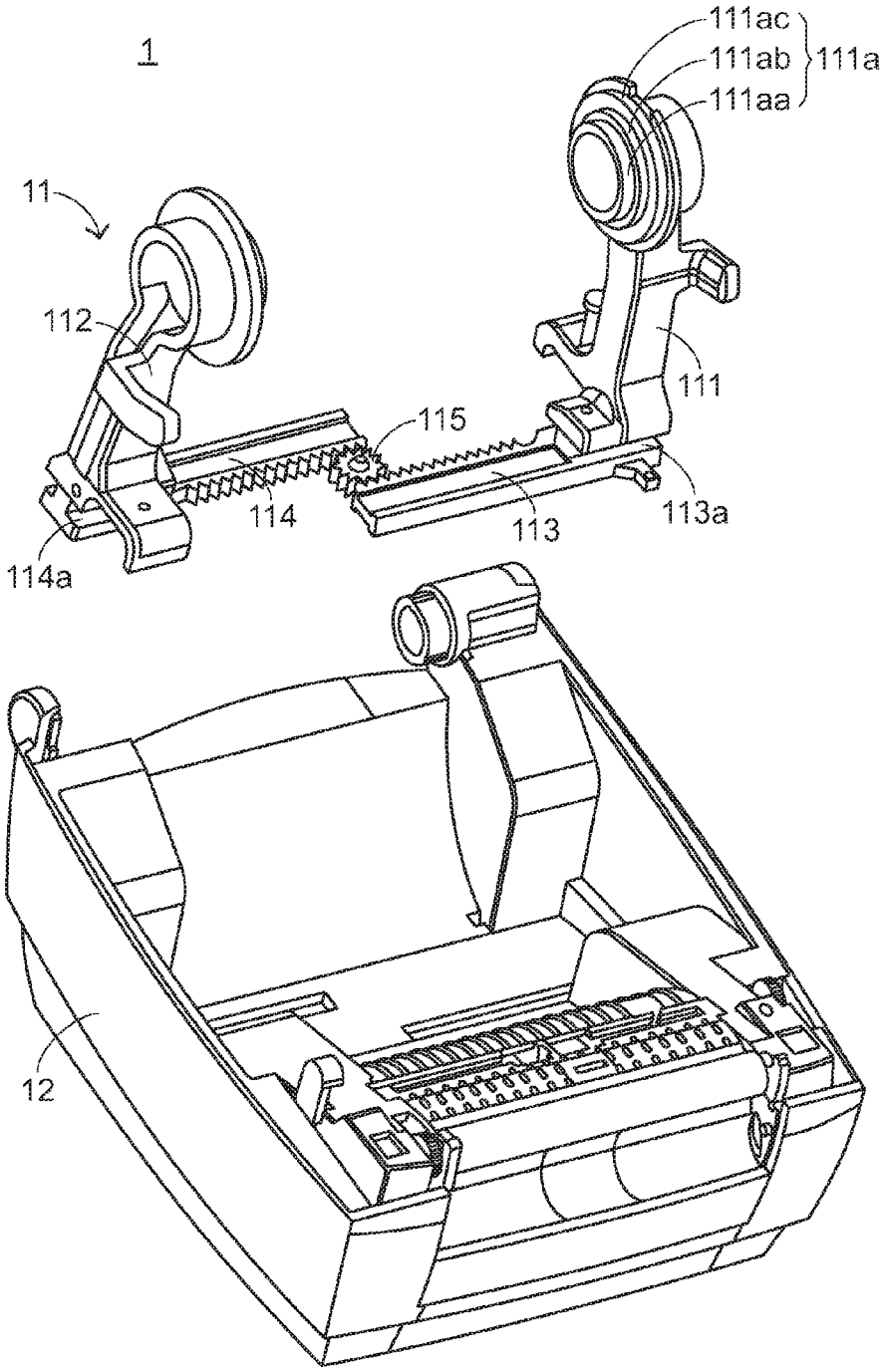
FIG.1 PRIOR ART
FIG. 1 is a schematic exploded view illustrating a conventional label printer.
Figure 2:
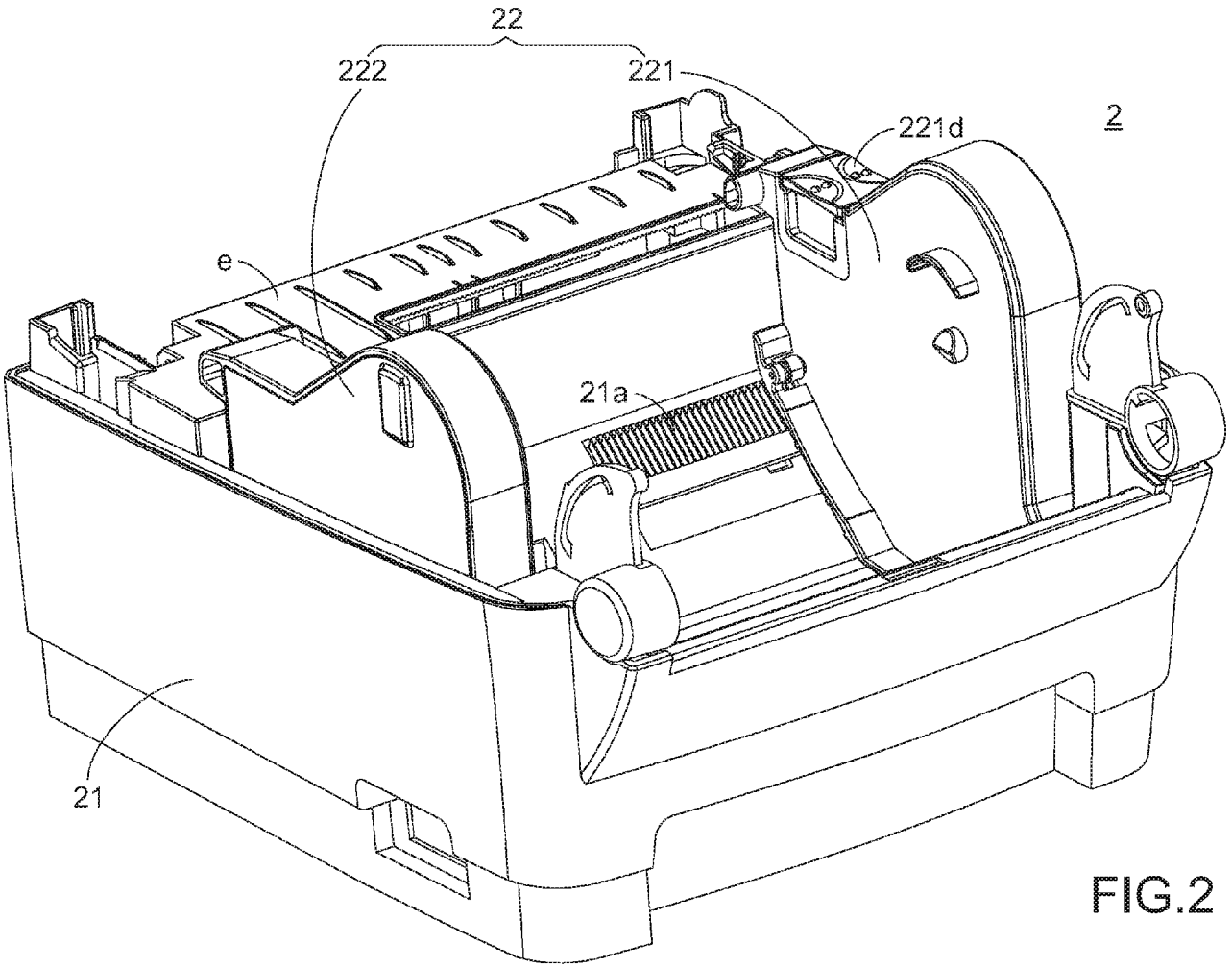
FIG. 2 is a schematic perspective view illustrating a printer according to a first embodiment of the present invention.

First of all, the components of the printer according to a first embodiment of the present invention will be illustrated in more details as follows. FIG. 2 is a schematic perspective view illustrating a printer according to a first embodiment of the present invention. As shown in FIG. 2, the printer 2 comprises a base 21, a paper roll fixing device 22, and an upper cover (not shown). The paper roll fixing device 22 is disposed within the base 21 (see FIG. 2). The upper cover is pivotally coupled with the base 21. Moreover, the upper cover is rotatable relative to the base 21 to be in an opened position or a closed position.

Figure 3:
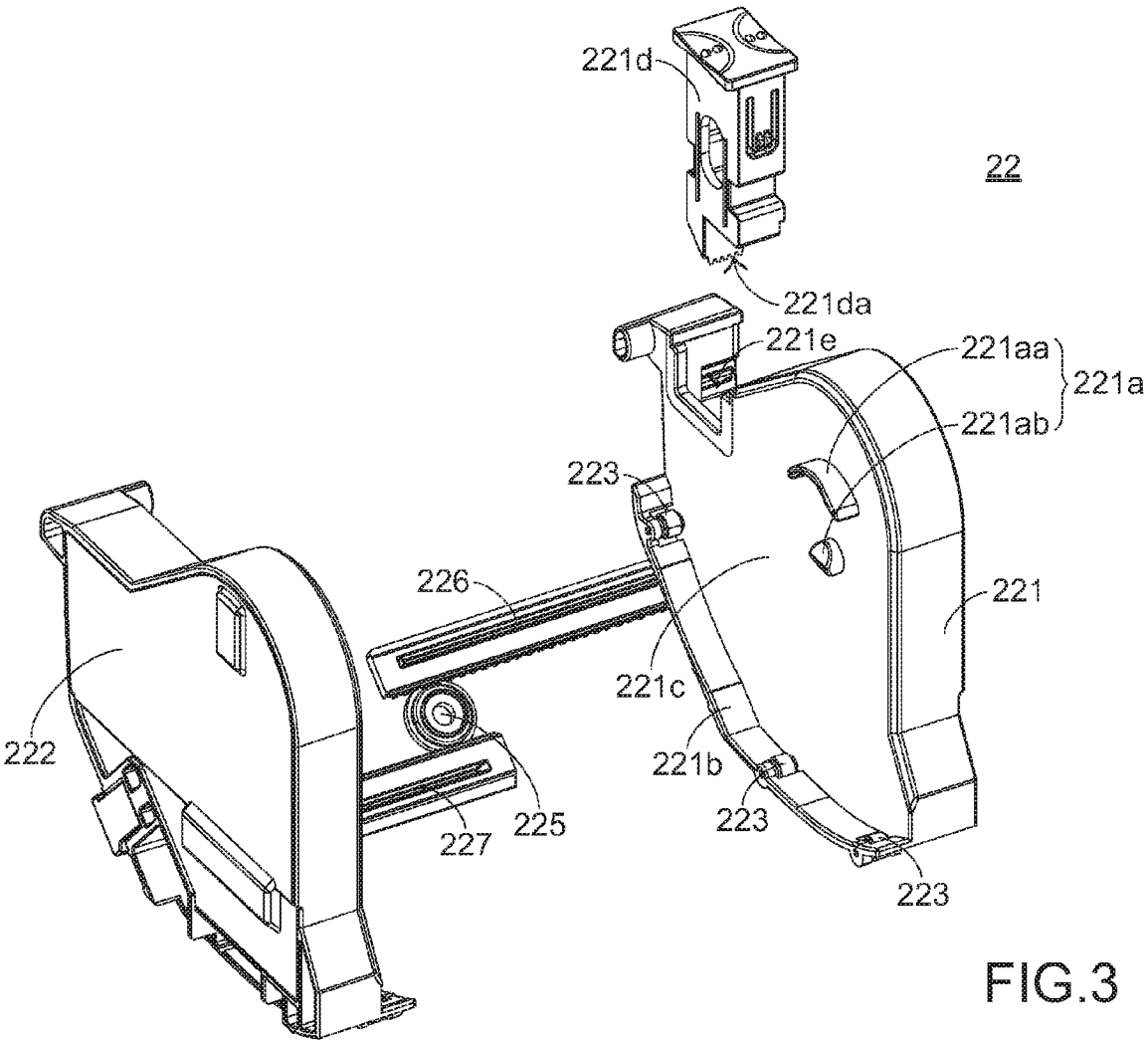
FIG. 3 is a schematic exploded view illustrating the paper roll fixing device according to the first embodiment of the present invention and taken along a first viewpoint.
Figure 4:
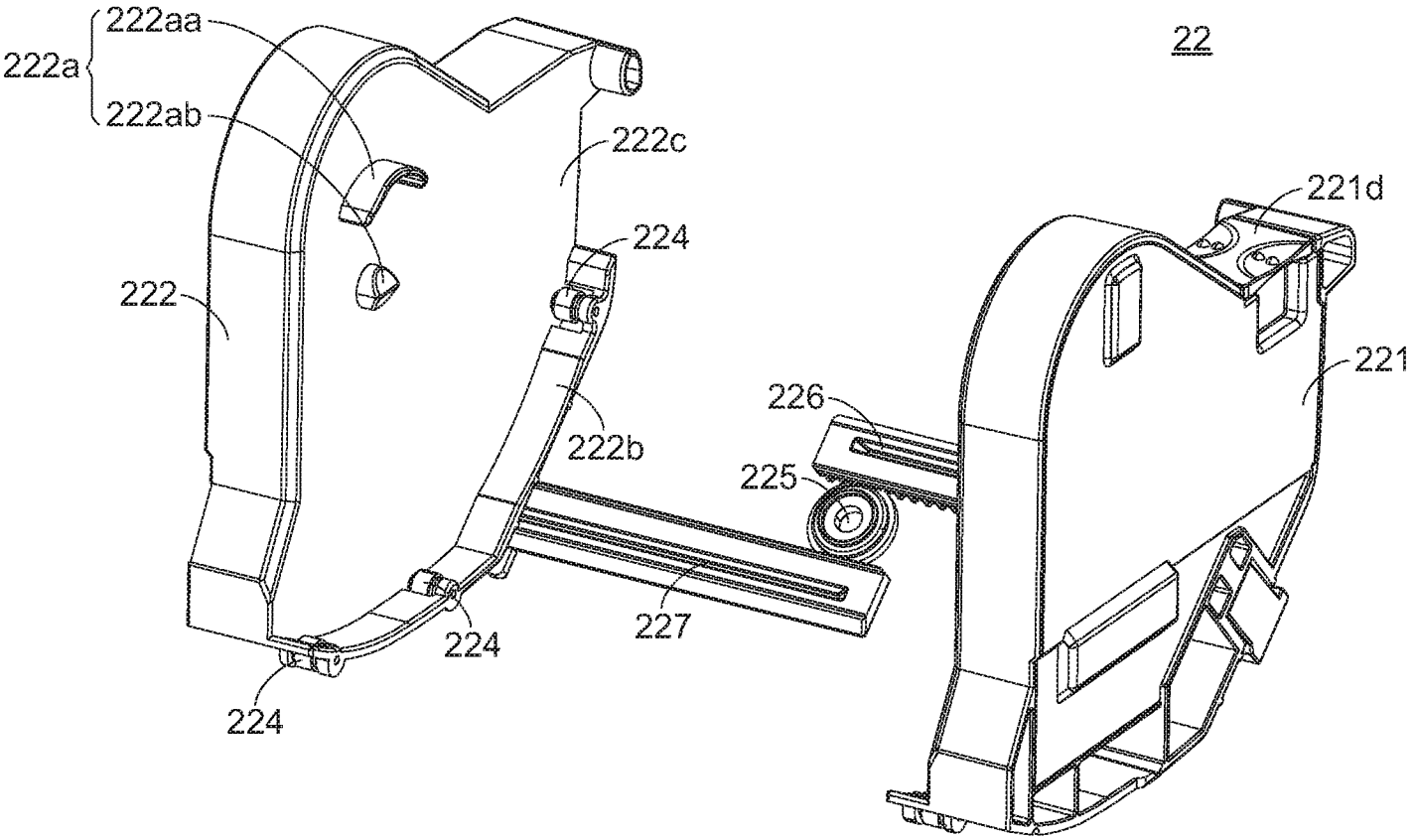
FIG. 4 is a schematic exploded view illustrating the paper roll fixing device according to the first embodiment of the present invention and taken along a second viewpoint.

FIG. 3 is a schematic exploded view illustrating the paper roll fixing device according to the first embodiment of the present invention and taken along a first viewpoint. FIG. 4 is a schematic exploded view illustrating the paper roll fixing device according to the first embodiment of the present invention and taken along a second viewpoint. As shown in FIGS. 3 and 4, the paper roll fixing device 22 comprises a first supporting member 221, a second supporting member 222, three first auxiliary rollers 223, three second auxiliary rollers 224, a rotating wheel 225, a first movable track 226, and a second movable track 227.

The first supporting member 221 comprises a first supporting protrusion part 221*a* and a first bottom plate 221*b*. The second supporting member 222 comprises a second supporting protrusion part 222*a* and a second bottom plate 222*b*. Moreover, the first supporting protrusion part 221*a* comprises a first bump 221*aa* and a second bump 221*ab*, and the second supporting protrusion part 222*a* comprises a third bump 222*aa* and a fourth bump 222*ab*.

Hereinafter, the sequence of assembling the printer according to the first embodiment of the present invention will be illustrated with reference to FIGS. 3 and 4. Firstly, the first supporting member 221 and the second supporting member 222 are provided. The first bump 221*aa* and the second bump 221*ab* are protruded from a first inner surface 221*c* of the first supporting member 221, and the first bump 221*aa* is located over the second bump 221*ab*. The third bump 222*aa* and the fourth bump 222*ab* are protruded from a second inner surface 222*c* of the second supporting member 222, and the third bump 222*aa* is located over the fourth bump 222*ab*.

The first bottom plate 221*b* is vertically extended from the bottom edge of the first inner surface 221*c* of the first supporting member 221. The three first auxiliary rollers 223 are discretely arranged on the first bottom plate 221*b*, and located below the first supporting protrusion part 221*a*. The second bottom plate 222*b* is vertically extended from the bottom edge of the second inner surface 222*c* of the second supporting member 222. The three second auxiliary rollers 224 are discretely arranged on the second bottom plate 222*b*, and located below the second supporting protrusion part 222*a*.

Then, the first movable track 226 is connected with the first supporting member 221, and perpendicular to the first supporting member 221. The second movable track 227 is connected with the second supporting member 222, and perpendicular to the second supporting member 222. In addition, the first supporting protrusion part 221*a* of the first supporting member 221 and the second supporting protrusion part 222*a* of the second supporting member 222 face each other.

Furthermore, the first movable track 226 and the second movable track 227 are parallel with each other, and are respectively engaged with the rotating wheel 225.

When the first supporting member 221 is moved, the first movable track 226 is linked with the second movable track 227 through the rotating wheel 225, so that the second supporting member 222 is moved toward the first supporting member 221 or away from the first supporting member 221. In such way, the distance between the first supporting member 221 and the second supporting member 222 is adjustable.

Similarly, when the second supporting member 222 is moved, the first supporting member 221 is moved toward the second supporting member 222 or away from the second supporting member 222 through linkage. In such way, the distance between the first supporting member 221 and the second supporting member 222 is also adjustable.

Please refer to FIGS. 2 and 3 again. In the first embodiment, the first supporting member 221 further comprises a locking member 221*d* and a perforation 221*e*. The locking member 221*d* has plural first toothed structures 221*da*. The base 21 further comprises plural second toothed structures 21*a*.

The locking member 221*d* is disposed within the perforation 221*e*. When the locking member 221*d* is moved upwardly, the plural first toothed structures 221*da* are not engaged with the plural second toothed structures 21*a*. Under this circumstance, the first supporting member 221 is movable. Consequently, the first movable track 226 is linked with the second movable track 227 and the second supporting member 222 through the rotating wheel 225.

When the locking member 221*d* is moved downwardly to result in engagement between the plural first toothed structures 221*da* and the plural second toothed structures 21*a*, the first supporting member 221 fails to be moved. Under this circumstance, since the first movable track 226 is not moved, the rotating wheel 225 fails to be rotated. Meanwhile, the second movable track 227 and the second supporting member 222 fail to be moved.

Figure 5:
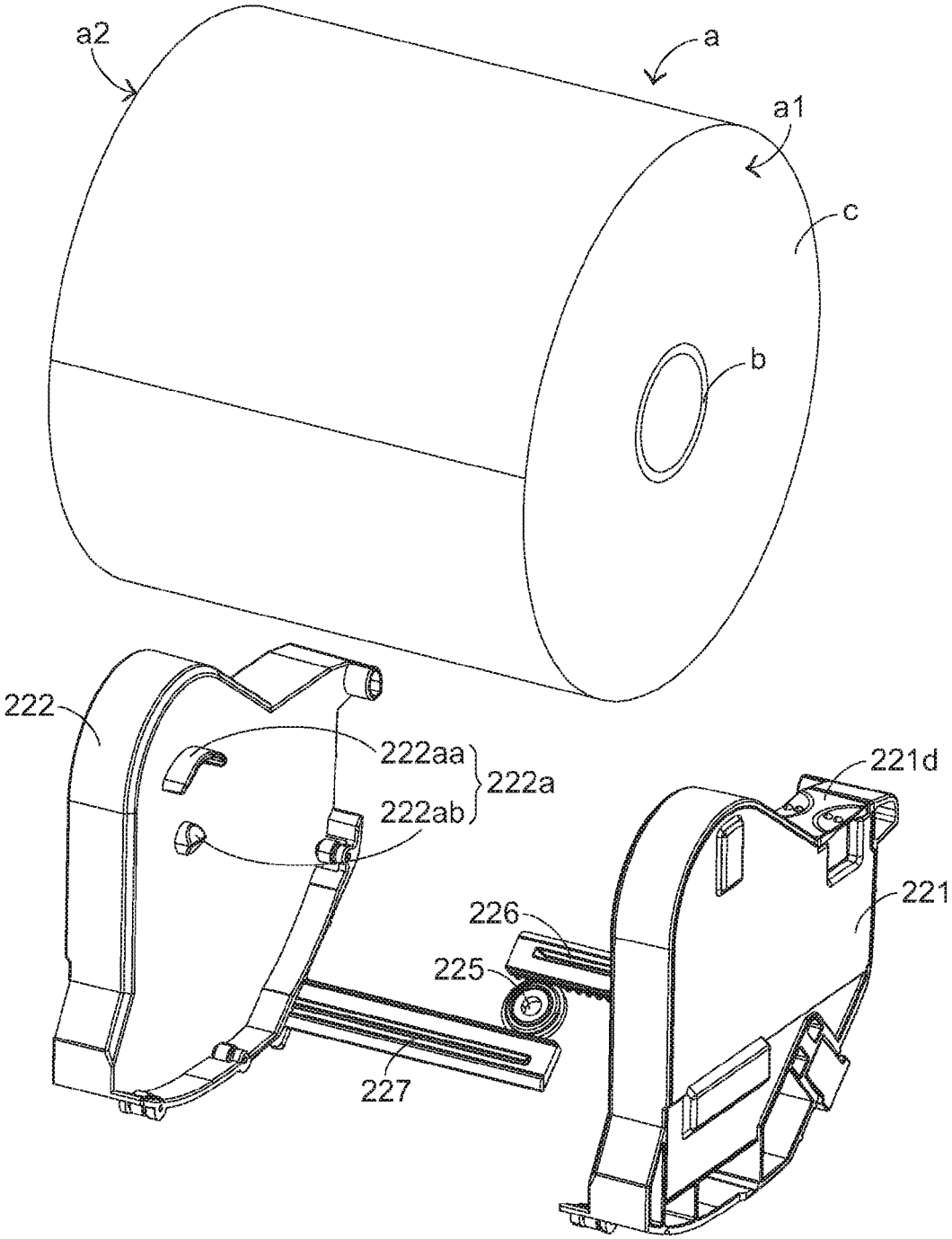
FIG. 5 is a schematic exploded view illustrating the relationship between a paper roll and the paper roll fixing device according to the first embodiment of the present invention.

Hereinafter, the operations of the printer according to the first embodiment of the present invention will be illustrated with reference to FIGS. 3, 4 and 5. FIG. 5 is a schematic exploded view illustrating the relationship between a paper roll and the paper roll fixing device according to the first embodiment of the present invention. As shown in FIG. 5, the paper roll a comprises a hollow shaft b and a paper tape c wound on the hollow shaft b. For installing the paper roll a within the printer 2, the locking member 221*d* is firstly moved upwardly to allow the first supporting member 221 and the second supporting member 222 to be freely moved. Then, by pulling the first supporting member 221 or the second supporting member 222, the first supporting member 221 and the second supporting member 222 are moved away from each other. Then, the first supporting protrusion part 221*a* is inserted into the hollow shaft b from a first end a1 of the hollow shaft b.

Then, the first supporting member 221 or the second supporting member 222 is no longer pulled. Then, the first supporting member 221 and the second supporting member 222 are moved toward each other until the second supporting protrusion part 222*a* of the second supporting member 222 is inserted into the hollow shaft b from a second end a2 of the hollow shaft b. Meanwhile, the paper roll a is fixed in the space between the first supporting member 221 and the second supporting member 222.

Afterwards, the locking member 221*d* is downwardly in order to prevent movement of the first supporting member 221 and the second supporting member 222 during the printing task is performed.

Figure 6:
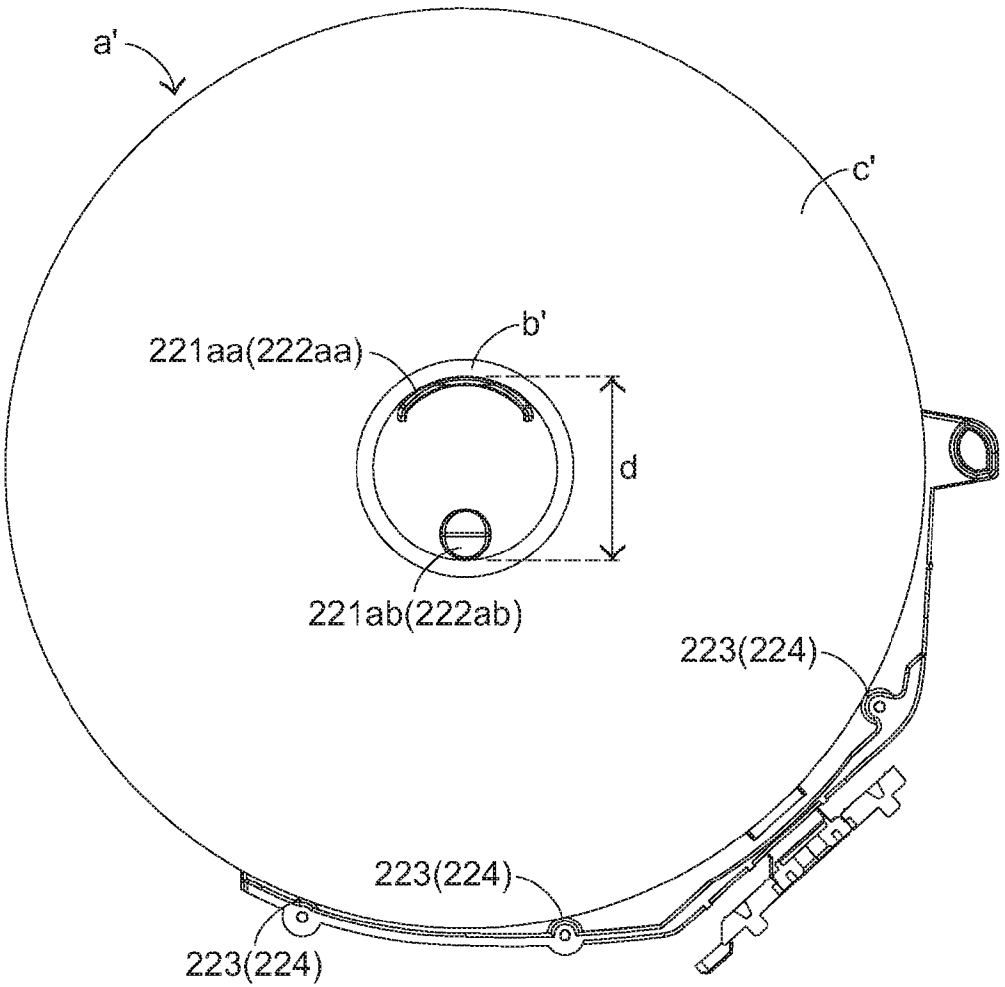
FIG. 6 is a schematic cross-sectional view illustrating a paper roll with a first-sized hollow shaft fixed in the space between the first supporting member and the second supporting member of the paper roll fixing device according to the first embodiment of the present invention.
Figure 7:
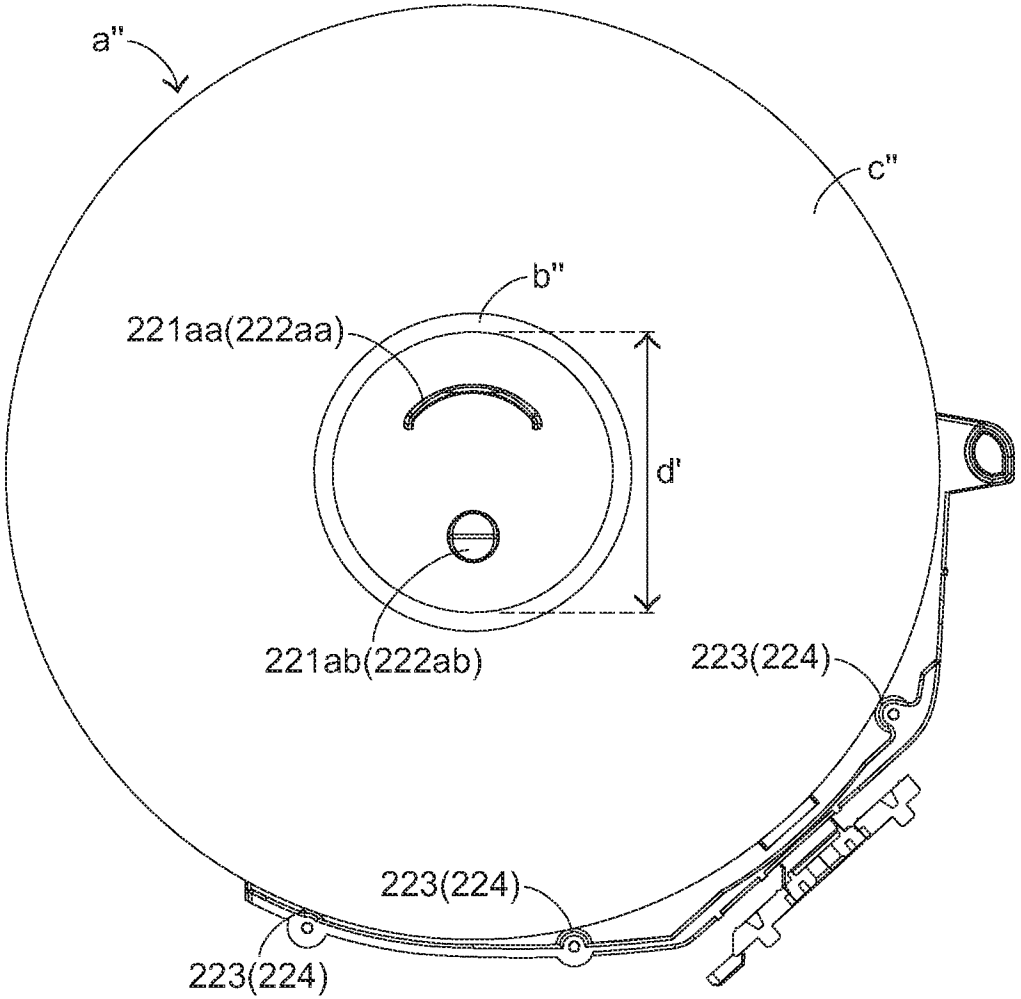
FIG. 7 is a schematic cross-sectional view illustrating a paper roll with a second-sized hollow shaft fixed in the space between the first supporting member and the second supporting member of the paper roll fixing device according to the first embodiment of the present invention.

Hereinafter, the ways of installing paper rolls with different-sized hollow shafts into the space between the first supporting member 221 and the second supporting member 222 will be illustrated with reference to FIG. 3, FIG. 4, FIG. 6 and FIG. 7. FIG. 6 is a schematic cross-sectional view illustrating a paper roll with a first-sized hollow shaft fixed in the space between the first supporting member and the second supporting member of the paper roll fixing device according to the first embodiment of the present invention. FIG. 7 is a schematic cross-sectional view illustrating a paper roll with a second-sized hollow shaft fixed in the space between the first supporting member and the second supporting member of the paper roll fixing device according to the first embodiment of the present invention.

As shown in FIG. 6, the first paper roll a' with a hollow shaft b' having a first diameter d is placed in the space between the first supporting member 221 and the second supporting member 222. That is, the first supporting protrusion part 221*a* and the second supporting protrusion part 222*a* are respectively inserted into the two ends of the hollow shaft b'. Under this circumstance, the top surfaces of the first bump 221*aa* and the third bump 222*aa* are respectively contacted with the two ends of the inner wall of the hollow shaft b', and the bottom surfaces of the second bump 221*ab* and the fourth bump 222*ab* are respectively contacted with the two ends of the inner wall of the hollow shaft b'.

Moreover, the three first auxiliary rollers 223 and the three second auxiliary rollers 224 are pressed by the two ends of an outer surface of the paper tape c', respectively.

Meanwhile, since the hollow shaft b' is supported by the first supporting protrusion part 221*a* and the second supporting protrusion part 222*a*, the first paper roll a' is not moved downwardly to touch the base 21. Consequently, during the printing task is performed, the three first auxiliary rollers 223 and the three second auxiliary rollers 224 can facilitate the paper tape c' to be moved more smoothly.

As shown in FIG. 7, the second paper roll a" with a hollow shaft b" having a second diameter d' is placed in the space between the first supporting member 221 and the second supporting member 222. The second diameter d' is greater than the first diameter d. The first bump 221*aa* and the second bump 221*ab* are inserted into a first end of the hollow shaft b". The third bump 222*aa* and the fourth bump 222*ab* are inserted into a second end of the hollow shaft b". However, all of the first bump 221*aa*, the second bump 221*ab*, the third bump 222*aa* and the fourth bump 222*ab* are not contacted with the inner wall of the hollow shaft b".

Meanwhile, since the hollow shaft b" is not supported by the first supporting protrusion part 221*a* and the second supporting protrusion part 222*a*, the second paper roll a" is moved downwardly in response to the gravity force. Moreover especially, since the three first auxiliary rollers 223 and the three second auxiliary rollers 224 are sustained against the two ends of an outer surface of the paper tape c" from the bottom of the second paper roll a" for supporting the second paper roll a", the paper tape c" is not directly contacted with the base 21. Moreover, during the printing task is performed, the three first auxiliary rollers 223 and the three second auxiliary rollers 224 can facilitate the paper tape c" to be moved more smoothly.

After the second paper roll a" has been used for a certain time period, the length of the paper tape c" is gradually decreased. Consequently, the position of the hollow shaft b" is gradually lowered down until the first bump 221*aa* and the third bump 222*aa* are respectively contacted with the two ends of the inner wall of the hollow shaft b".

Meanwhile, the second paper roll a" can be supported by the first bump 221*aa* and the third bump 222*aa*, and the position of the second paper roll a" can be effectively maintained. Under this circumstance, since the second paper roll a" is not moved downwardly in response to the gravity force, the altitude difference between the hollow shaft b" and the exit e (see FIG. 2) is no longer increased. As a consequently, during the printing task is performed, the second paper roll a" is not moved up and down, the printing performance will be enhanced.

In accordance with the present invention, the first diameter d is the minimum diameter of the hollow shaft of the paper roll among all commercially available paper rolls.

Figure 8:
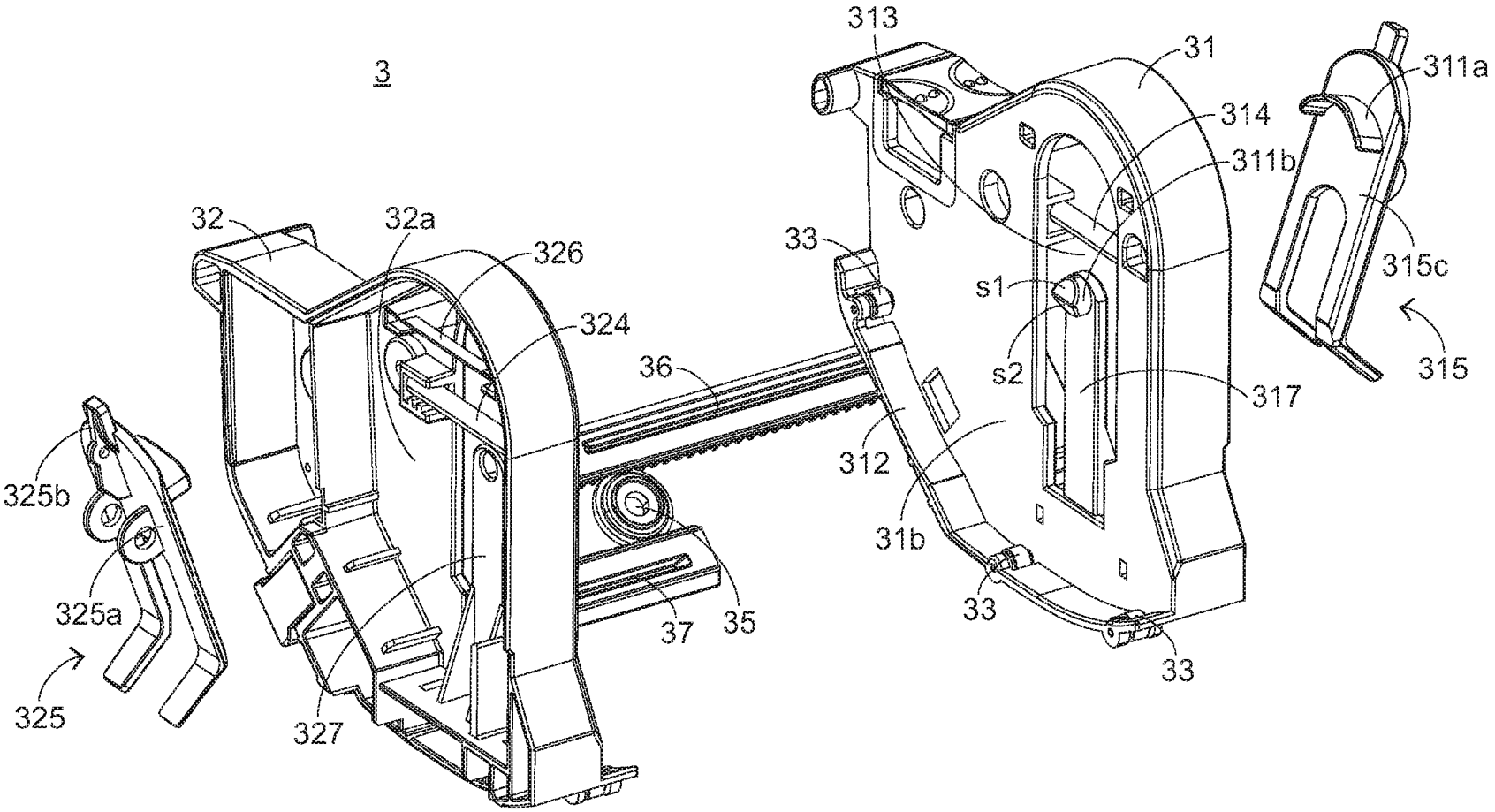
FIG. 8 is a schematic exploded view illustrating a paper roll fixing device according to a second embodiment of the present invention and taken along a first viewpoint.
Figure 9:
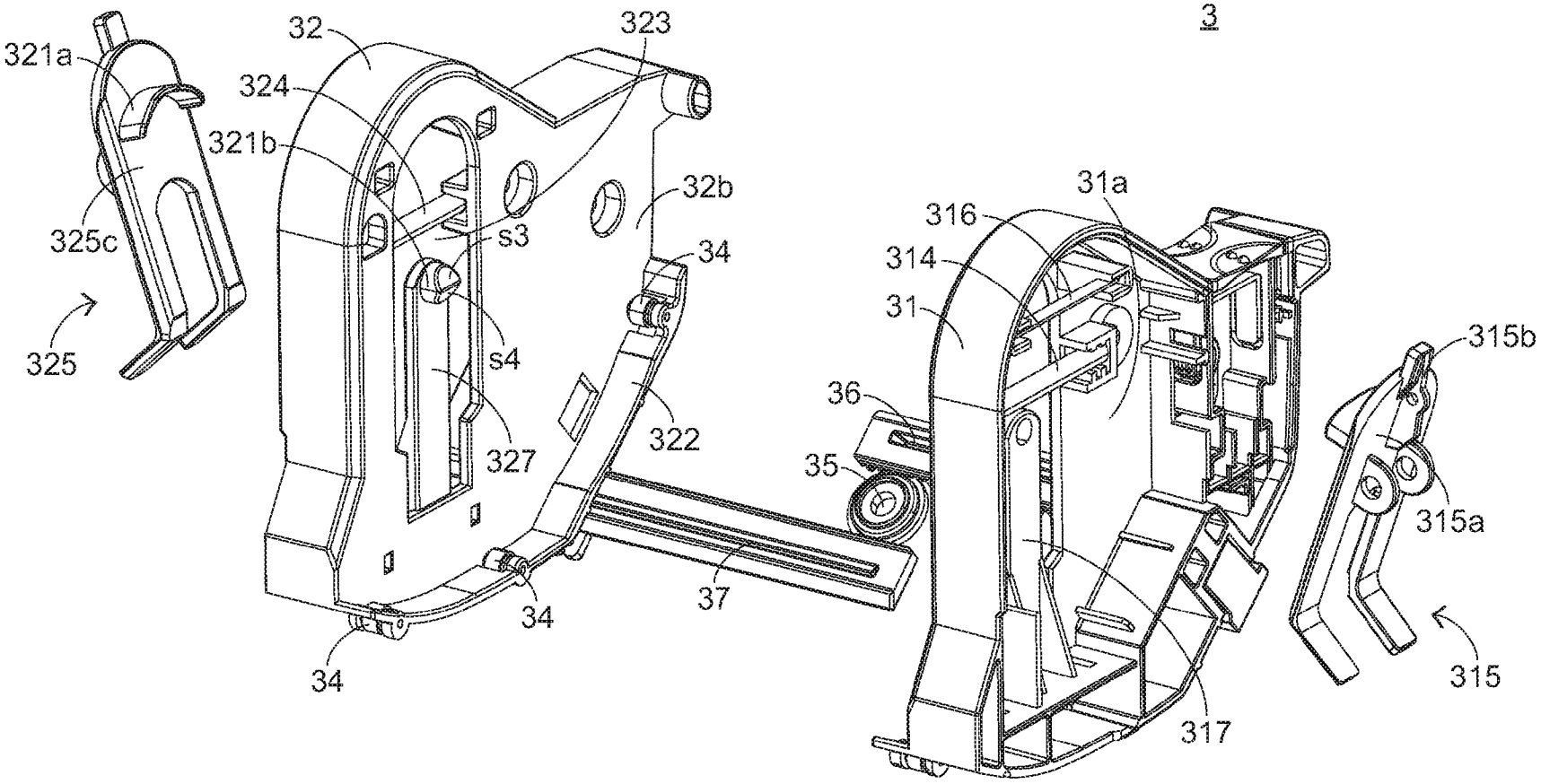
FIG. 9 is a schematic exploded view illustrating the paper roll fixing device according to the second embodiment of the present invention and taken along a second viewpoint.
Figure 10:
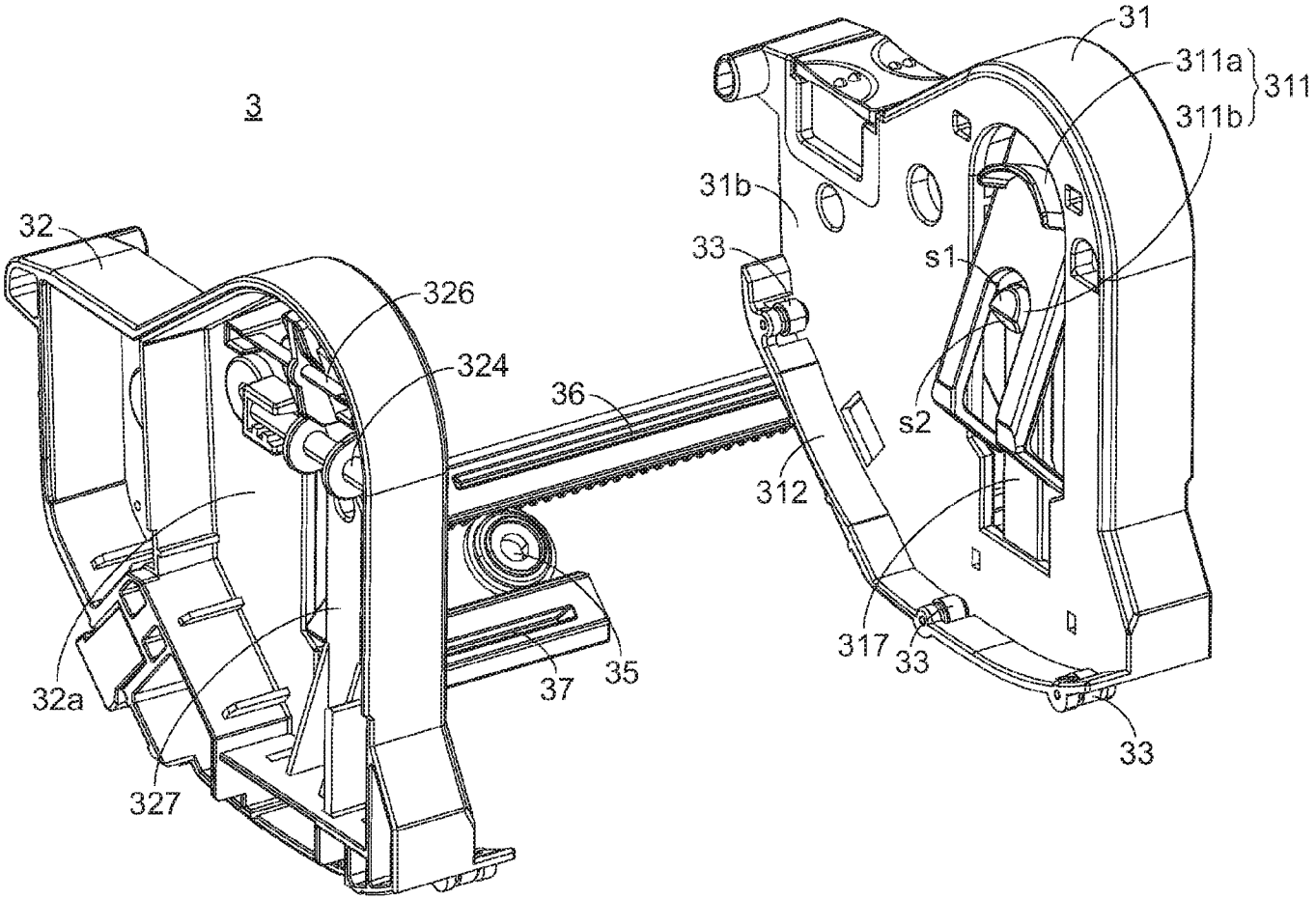
FIG. 10 is a schematic assembled view illustrating the paper roll fixing device according to the second embodiment of the present invention and taken along the first viewpoint.
Figure 11:
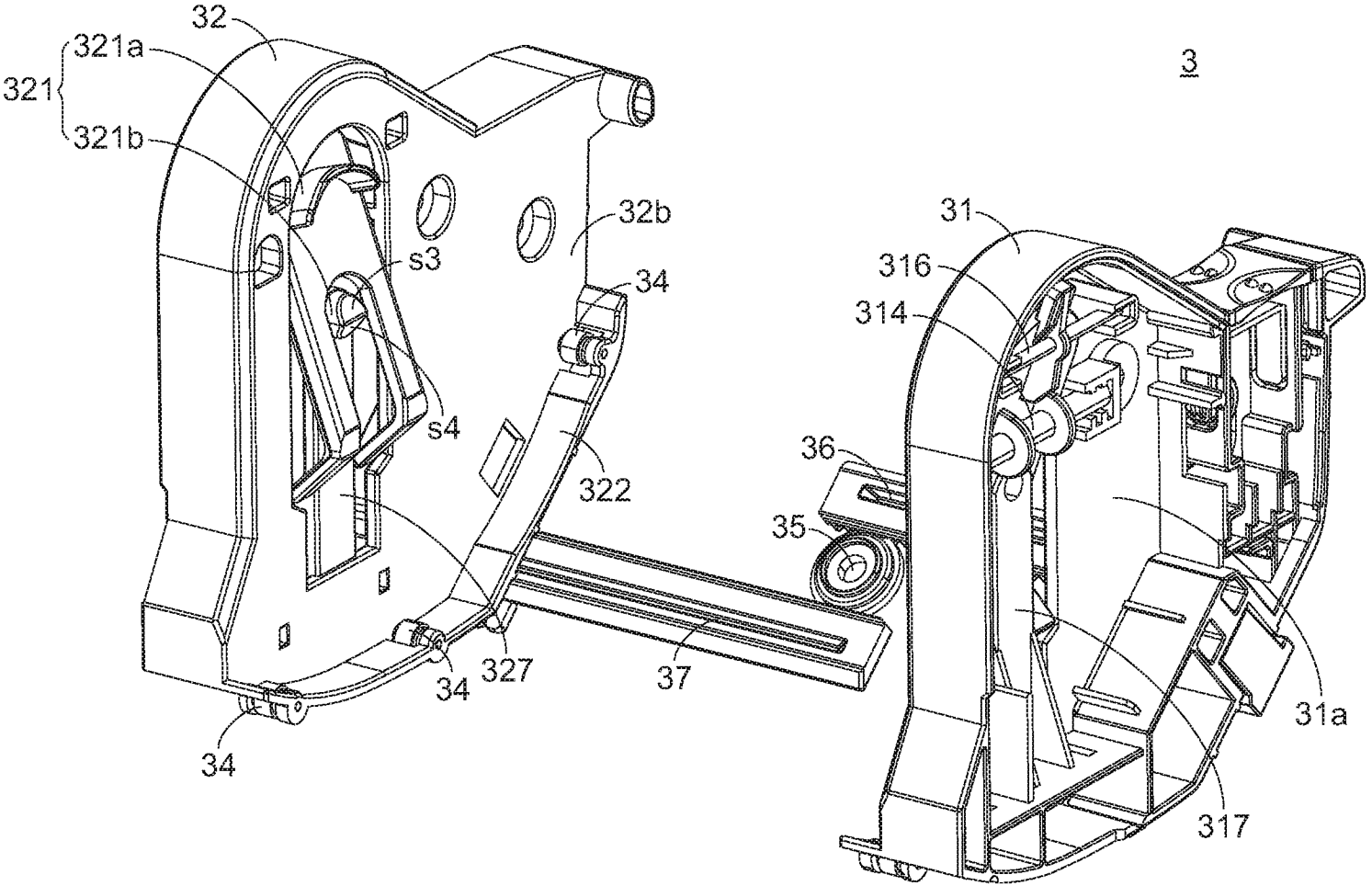
FIG. 11 is a schematic assembled view illustrating the paper roll fixing device according to the second embodiment of the present invention and taken along the second viewpoint.

It is noted that numerous modifications and alterations of the paper roll fixing device 22 may be made while retaining the teachings of the invention. The components of the paper roll fixing device according to a second embodiment of the present invention will be illustrated in more details as follows. FIG. 8 is a schematic exploded view illustrating a paper roll fixing device according to a second embodiment of the present invention and taken along a first viewpoint. FIG. 9 is a schematic exploded view illustrating the paper roll fixing device according to the second embodiment of the present invention and taken along a second viewpoint. FIG. 10 is a schematic assembled view illustrating the paper roll fixing device according to the second embodiment of the present invention and taken along the first viewpoint. FIG. 11 is a schematic assembled view illustrating the paper roll fixing device according to the second embodiment of the present invention and taken along the second viewpoint.

As shown in FIGS. 8~11, the paper roll fixing device 3 comprises a first supporting member 31, a second supporting member 32, three first auxiliary rollers 33, three second auxiliary rollers 34, a rotating wheel 35, a first movable track 36, and a second movable track 37.

The first supporting member 31 comprises a first supporting protrusion part 311, a first bottom plate 312, a first through-hole 313, a first shaft 314, a first fixing slab 315, a first elastic element 316, and a first propping sheet 317. The second supporting member 32 comprises a second supporting protrusion part 321, a second bottom plate 322, a second through-hole 323, a second shaft 324, a second fixing slab 325, a second elastic element 326, and a second propping sheet 327. Furthermore, the first supporting protrusion part 311 comprises a first bump 311*a* and a second bump 311*b*, and the second supporting protrusion part 321 comprises a third bump 321*a* and a fourth bump 321*b*.

Furthermore, the second bump 311*b* comprises a first slant surface s1 and a second slant surface s2, and the fourth bump 321*b* comprises a first slant surface s3 and a second slant surface s4. The first propping sheet 317 and the second propping sheet 327 are made of flexible materials.

Hereinafter, the sequence of assembling the paper roll fixing device according to the second embodiment of the present invention will be illustrated with reference to FIGS. 8~11 again.

Firstly, the first supporting member 31 is provided. The first through-hole 313 is formed in the first supporting member 31. The first shaft 314 is disposed on a first outer surface 31*a* of the first supporting member 31. The first elastic element 316 is also disposed on the first outer surface 31*a* of the first supporting member 31. In addition, the first elastic element 316 is located over the first shaft 314.

The first propping sheet 317 is upwardly protruded from a bottom periphery of the first through-hole 313. The second bump 311*b* is protruded from the first propping sheet 317 and protruded over a first inner surface 31*b* of the first supporting member 31.

Moreover, the first shaft 314 is pivotally coupled with a first side 315*a* of the first fixing slab 315. Consequently, the first fixing slab 315 is located over the first propping sheet 317, which is disposed within the first through-hole 313. The first elastic element 316 is connected with a first end 315*b* of the first fixing slab 315 from the first side 315*a* of the first fixing slab 315. The first bump 311*a* is protruded from a second side 315*c* of the first fixing slab 315.

Next, the second supporting member 32 is provided. The second through-hole 323 is formed in the second supporting member 32. The second shaft 324 is disposed on a second outer surface 32*a* of the second supporting member 32. The second elastic element 326 is also disposed on the second outer surface 32*a* of the second supporting member 32. In addition, the second elastic element 326 is located over the second shaft 324.

The second propping sheet 327 is upwardly protruded from a bottom periphery of the second through-hole 323. The fourth bump 321*b* is protruded from the second propping sheet 327 and protruded over a second inner surface 32*b* of the second supporting member 32.

Moreover, the second shaft 324 is pivotally coupled with a first side 325*a* of the second fixing slab 325. Consequently, the second fixing slab 325 is located over the second propping sheet 327, which is disposed within the second through-hole 323. The second elastic element 326 is connected with a second end 325*b* of the second fixing slab 325 from the first side 325*a* of the second fixing slab 325. The second bump 321*a* is protruded from a second side 325*c* of the second fixing slab 325.

Moreover, the first bottom plate 312 is vertically extended from the bottom edge of the first inner surface 31*b* of the first supporting member 31. The three first auxiliary rollers 33 are discretely arranged on the first bottom plate 312, and located below the first supporting protrusion part 311. The second bottom plate 322 is vertically extended from the bottom edge of the second inner surface 32*b* of the second supporting member 32. The three second auxiliary rollers 34 are discretely arranged on the second bottom plate 322, and located below the second supporting protrusion part 321.

Then, the first movable track 36 is connected with the first supporting member 31, and perpendicular to the first supporting member 31. The second movable track 37 is connected with the second supporting member 32, and perpendicular to the second supporting member 32. In addition, the first supporting protrusion part 311 of the first supporting member 31 and the second supporting protrusion part 321 of the second supporting member 32 face each other.

Furthermore, the first movable track 36 and the second movable track 37 are parallel with each other, and are respectively engaged with the rotating wheel 35.

After the paper roll is placed in the space between the first supporting member 31 and the second supporting member 32, the printing task is performed. During the printing task is performed, the operations of the first supporting protrusion part 311, the second supporting protrusion part 321, the three first auxiliary rollers 33 and the three second auxiliary rollers 34 are similar to the corresponding components of the paper roll fixing device of the first embodiment, and are not redundantly described herein.

In views of the following features, the paper roll fixing device of the second embodiment is distinguished from the paper roll fixing device of the first embodiment. During the paper roll is placed in the space between the first supporting member 31 and the second supporting member 32, the first bump 311*a*, the second bump 311*b*, the third bump 321*a* and the fourth bump 321*b* can be automatically inserted into the hollow shaft of the paper roll. The reasons will be illustrated in more details as follows.

Figure 12:
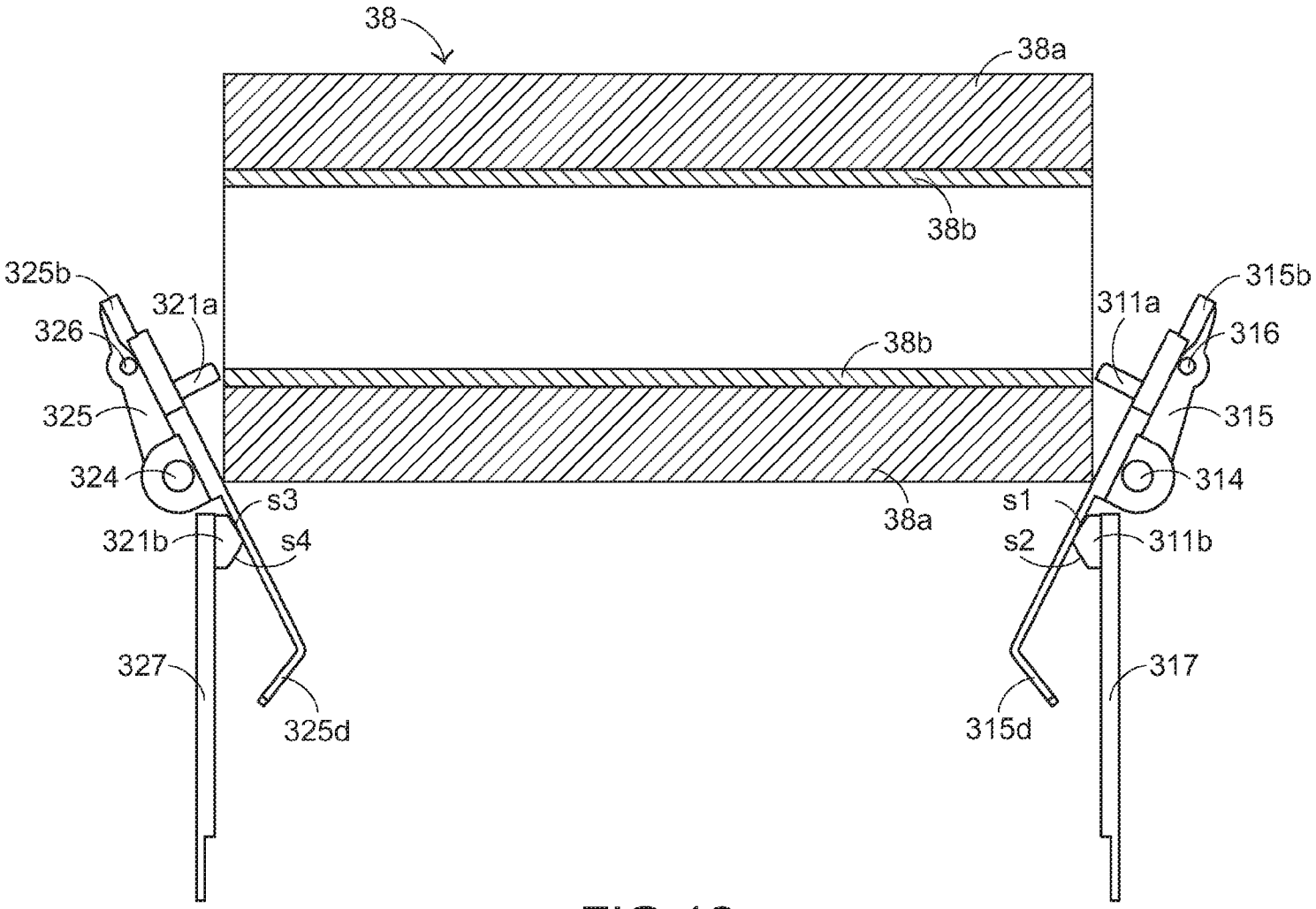
FIG. 12 is a schematic cross-sectional view illustrating the paper roll fixing device according to the second embodiment of the present invention, in which the paper roll has not been installed within the paper roll fixing device.
Figure 13:
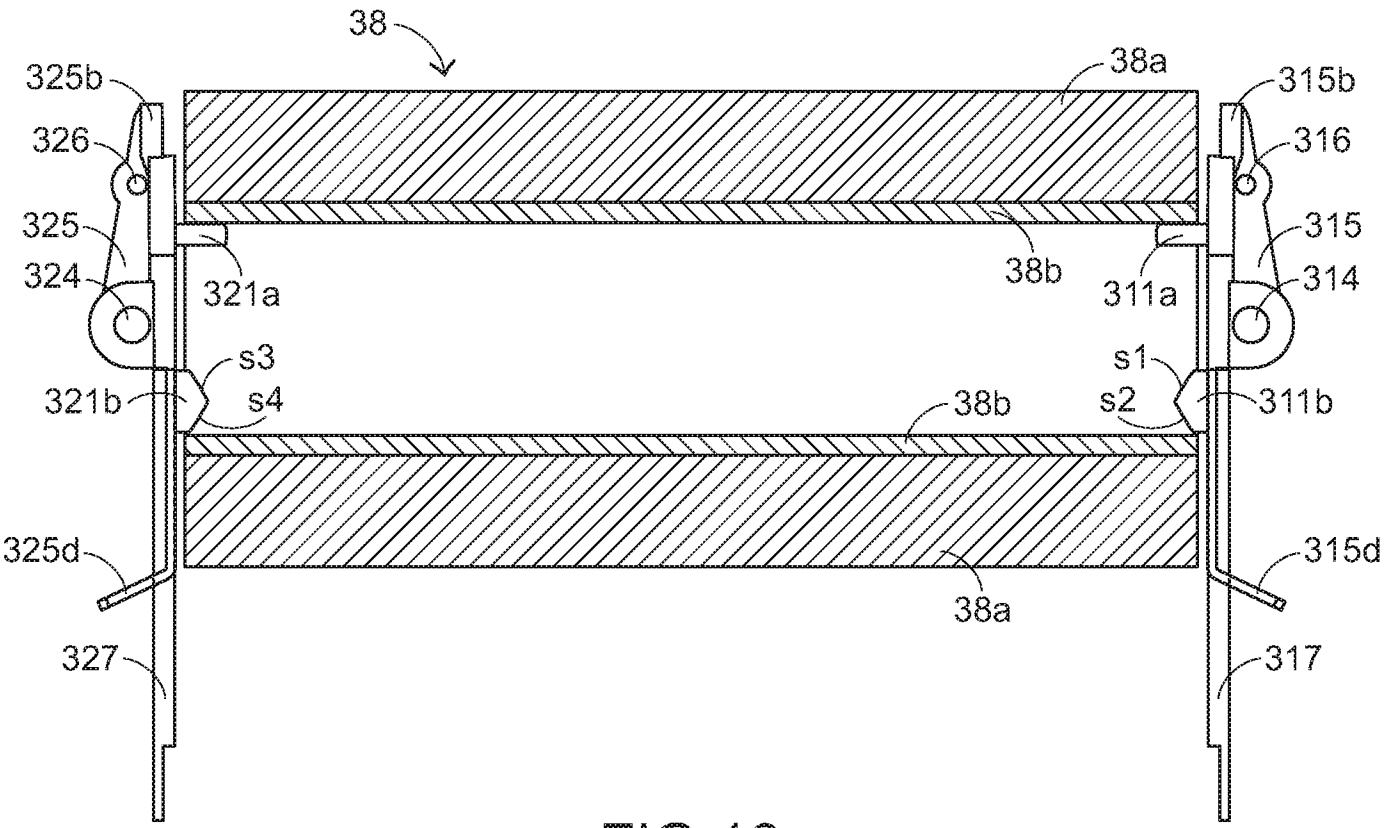
FIG. 13 is a schematic cross-sectional view illustrating the paper roll fixing device according to the second embodiment of the present invention, in which the paper roll has been installed within the paper roll fixing device.

FIG. 12 is a schematic cross-sectional view illustrating the paper roll fixing device according to the second embodiment of the present invention, in which the paper roll has not been installed within the paper roll fixing device. FIG. 13 is a schematic cross-sectional view illustrating the paper roll fixing device according to the second embodiment of the present invention, in which the paper roll has been installed within the paper roll fixing device. Please refer to FIGS. 10~13. The paper roll 38 comprises a hollow shaft 38*b* and a paper tape 38*a* wound on the hollow shaft 38*b*. Before the paper roll 38 is installed within the paper roll fixing device 3, due to a pulling force of the first elastic element 316, the first end 315*b* of the first fixing slab 315 is rotated toward the first outer surface 31*a* of the first supporting member 31 by using the first shaft 314 as a fulcrum. Under this circumstance, the first bump 311*a* is not protruded outside the first inner surface 31*b*, and thus the second end 315*d* of the first fixing slab 315 is protruded outside the first inner surface 31*b*.

Similarly, due to a pulling force of the second elastic element 326, the first end 325*b* of the second fixing slab 325 is rotated toward the second outer surface 32*a* of the second supporting member 32 by using the second shaft 324 as a fulcrum. Under this circumstance, the third bump 321*a* is not protruded outside the second inner surface 32*b*, and thus the second end 325*d* of the second fixing slab 325 is protruded outside the second inner surface 32*b*.

During the process of introducing the paper roll 38 into the space between the first supporting member 31 and the second supporting member 32 from top to down, the second end 315*d* of the first fixing slab 315 and the second end 325*d* of the second fixing slab 325 are simultaneously pushed by the both ends of the paper roll 38, respectively. Under this circumstance, the second end 315*d* of the first fixing slab 315 is rotated toward the first outer surface 31*a* of the first supporting member 31 by using the first shaft 314 as a fulcrum, and the second end 325*d* of the second fixing slab 325 is rotated toward the second outer surface 32*a* of the second supporting member 32 by using the second shaft 324 as a fulcrum.

As the paper roll 38 is continuously moved downwardly, the second bump 311*b* of the first propping sheet 317 and the fourth bump 321*b* of the second propping sheet 327 are pressed by the two ends of the paper roll 38. Under this circumstance, the second bump 311*b* is moved toward the first outer surface 31*a* of the first supporting member 31, and the fourth bump 321*b* is moved toward the second outer surface 32*a* of the second supporting member 32. Consequently, the paper roll 38 can be smoothly transported through the space between the first slant surface s1 of the second bump 311*b* and the first slant surface s3 of the fourth bump 321*b*.

After the paper roll 38 is completely placed in the space between the first supporting member 31 and the second supporting member 32, the first fixing slab 315 and the second fixing slab 325 are rotated to be parallel with the first supporting member 31 and the second supporting member 32. Meanwhile, the first bump 311*a* of the first fixing slab 315 is protruded outside the first inner surface 31*b* of the first supporting member 31, and the third bump 321*a* of the second fixing slab 325 is protruded outside the second inner surface 32*b* of the second supporting member 32. As a consequence, the first bump 311*a* and the third bump 321*a* are inserted into the hollow shaft 38*b* of the paper roll 38, and the top surfaces of the first bump 311*a* and the third bump 321*a* are respectively contacted with the two ends of the inner wall of the hollow shaft 38*b*.

Meanwhile, since the pushing force of the paper roll 38 is no longer exerted on the first propping sheet 317 and the second propping sheet 327, the first propping sheet 317 and the second propping sheet 327 are returned to the original positions due to the toughness properties thereof. As a consequence, the second bump 311*b* and the fourth bump 321*b* are inserted into the hollow shaft 38*b* of the paper roll 38, and the bottom surfaces of the second bump 311*b* and the fourth bump 321*b* are respectively contacted with the two ends of the inner wall of the hollow shaft 38*b*. Under this circumstance, the paper roll 38 is securely fixed in the space between the first supporting member 31 and the second supporting member 32.

For removing the paper roll 38 from the space between the first supporting member 31 and the second supporting member 32, the paper roll 38 is moved upwardly, so that the second bump 311*b* of the first propping sheet 317 and the fourth bump 321*b* of the second propping sheet 327 are pushed upwardly by the two ends of the paper roll 38. Under this circumstance, the second bump 311*b* is moved toward the first outer surface 31*a* of the first supporting member 31, and the fourth bump 321*b* is moved toward the second outer surface 32*a* of the second supporting member 32. Consequently, the paper roll 38 can be smoothly transported through the space between the second slant surface s2 of the second bump 311*b* and the second slant surface s4 of the fourth bump 321*b*.

At the same time, the second end 315*d* of the first fixing slab 315 and the second end 325*d* of the second fixing slab 325 are no longer pushed by the two ends of the paper roll 38. Due to a restoring force of the first elastic element 316, the first end 315*b* of the first fixing slab 315 is rotated toward the first outer surface 31*a* of the first supporting member 31 by using the first shaft 314 as a fulcrum. Consequently, the first bump 311*a* is returned to the original position, and the first bump 311*a* is no longer protruded outside the first inner surface 31*b*. Similarly, due to a restoring force of the second elastic element 326, the first end 325*b* of the second fixing slab 325 is rotated toward the second outer surface 32*a* of the second supporting member 32 by using the second shaft 324 as a fulcrum. Consequently, the third bump 321*a* is returned to the original position, and the third bump 321*a* is no longer protruded outside the second inner surface 32*b*. Under this circumstance, the paper roll 38 can be removed upwardly without being hindered.

After the paper roll 38 is completely removed, the pushing force of the paper roll 38 is no longer exerted on the second bump 311*b* and the fourth bump 321*b*. As a consequence, the second bump 311*b* and the fourth bump 321*b* are returned to the original positions due to the toughness properties thereof.

Figure 14:
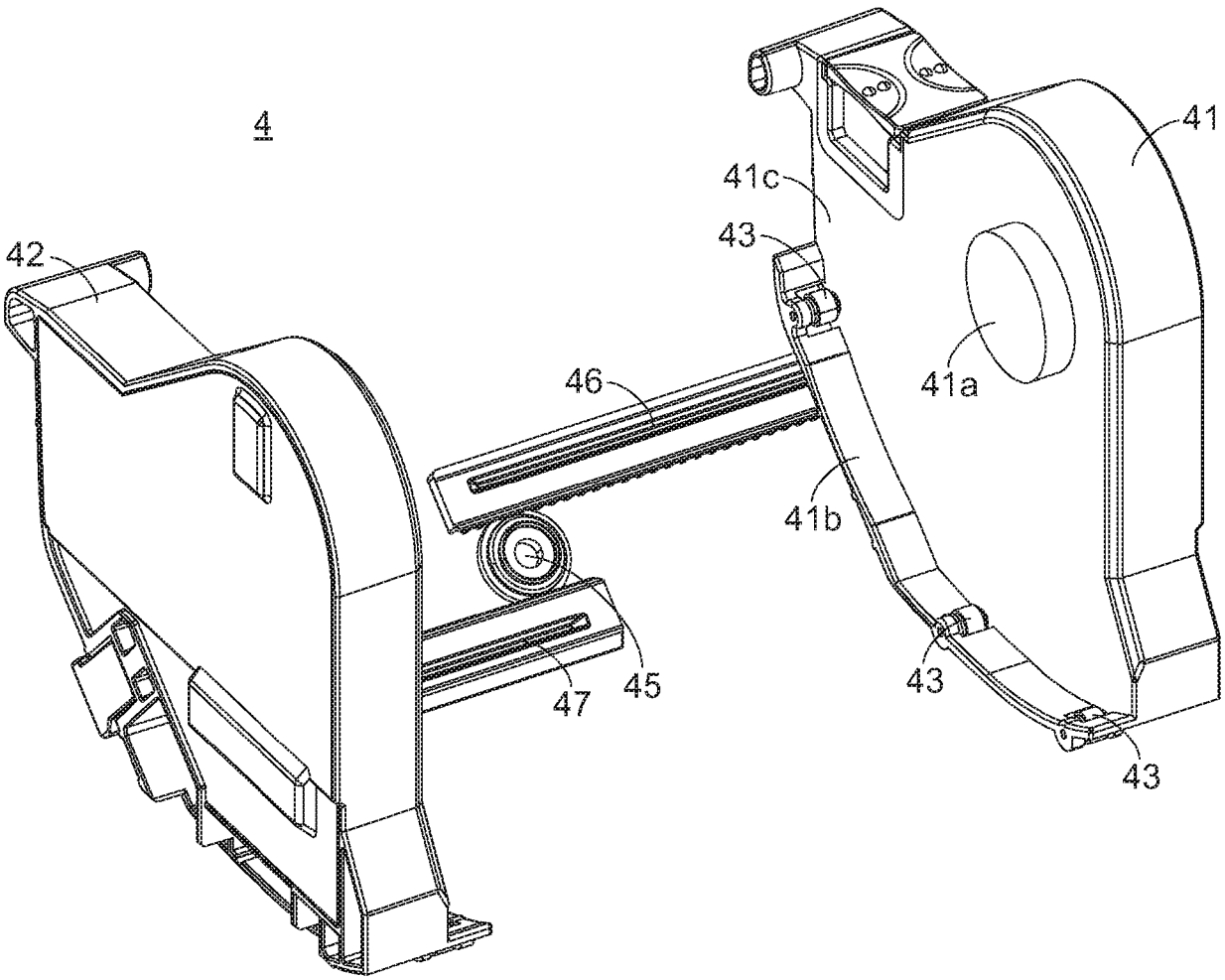
FIG. 14 is a schematic perspective view illustrating a paper roll fixing device according to a third embodiment of the present invention and taken along a first viewpoint.
Figure 15:
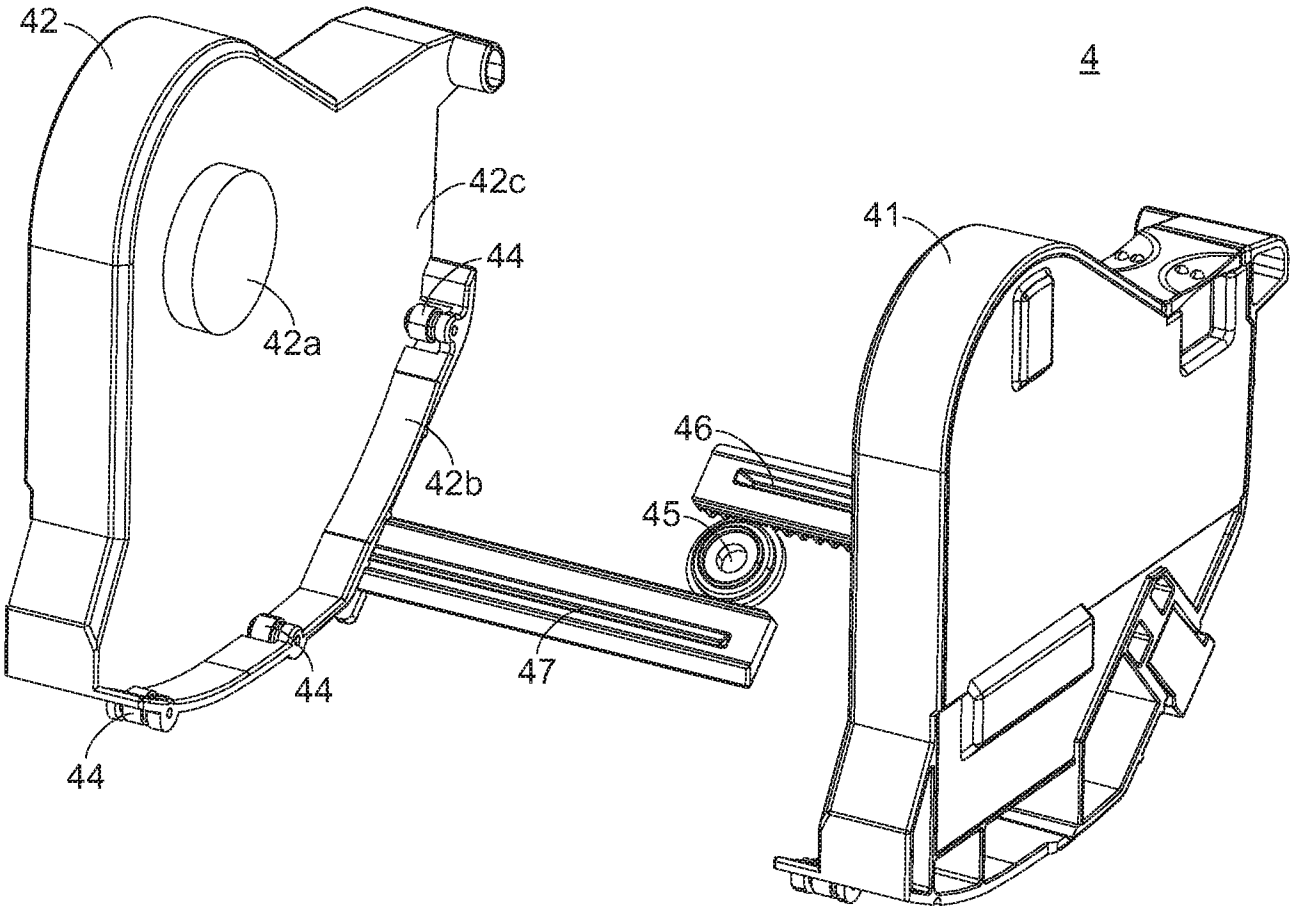
FIG. 15 is a schematic perspective view illustrating the paper roll fixing device according to the third embodiment of the present invention and taken along a second viewpoint.

The paper roll fixing devices of the above two embodiments are presented herein for purpose of illustration and description only. The present invention further provides a paper roll fixing device of a third embodiment. FIG. 14 is a schematic perspective view illustrating a paper roll fixing device according to a third embodiment of the present invention and taken along a first viewpoint. FIG. 15 is a schematic perspective view illustrating the paper roll fixing device according to the third embodiment of the present invention and taken along a second viewpoint.

Hereinafter, the components of the paper roll fixing device according to the third embodiment of the present invention will be illustrated with reference to FIGS. 14 and 15. As shown in FIGS. 14 and 15, the paper roll fixing device 4 comprises a first supporting member 41, a second supporting member 42, three first auxiliary rollers 43, three second auxiliary rollers 44, a rotating wheel 45, a first movable track 46, and a second movable track 47.

The first supporting member 41 comprises a first supporting protrusion part 41*a* and a first bottom plate 41*b*. The second supporting member 42 comprises a second supporting protrusion part 42*a* and a second bottom plate 42*b*.

Hereinafter, the sequence of assembling the paper roll fixing device according to the third embodiment of the present invention will be illustrated with reference to FIGS. 14 and 15. Firstly, the first supporting member 41 and the second supporting member 42 are provided. The first supporting protrusion part 41*a* is protruded from a first inner surface 41*c* of the first supporting member 41, and the second supporting protrusion part 42*a* is protruded from a second inner surface 42*c* of the second supporting member 42.

The first bottom plate 41*b* is vertically extended from the bottom edge of the first inner surface 41*c* of the first supporting member 41. The three first auxiliary rollers 43 are discretely arranged on the first bottom plate 41*b*, and located below the first supporting protrusion part 41*a*. The second bottom plate 42*b* is vertically extended from the bottom edge of the second inner surface 42*c* of the second supporting member 42. The three second auxiliary rollers 44 are discretely arranged on the second bottom plate 42*b*, and located below the second supporting protrusion part 42*a*.

Then, the first movable track 46 is connected with the first supporting member 41, and perpendicular to the first supporting member 41. The second movable track 47 is connected with the second supporting member 42, and perpendicular to the second supporting member 42. In addition, the first supporting protrusion part 41*a* of the first supporting member 41 and the second supporting protrusion part 42*a* of the second supporting member 42 face each other.

Furthermore, the first movable track 46 and the second movable track 47 are parallel with each other, and are respectively engaged with the rotating wheel 45.

In comparison with the first embodiment, both of the first supporting protrusion part 41*a* and the second supporting protrusion part 42*a* are cylindrical bumps (see FIGS. 14 and 15). In addition, the diameter of the cylindrical bump is equal to the first diameter d of the hollow shaft b' of the first paper roll a' as shown in FIG. 6. It is noted that, however, those skilled in the art will readily observe that numerous modifications and alterations may be made while retaining the teachings of the invention. For example, in some embodiments, both of the first supporting protrusion part 41*a* and the second supporting protrusion part 42*a* are ring-shaped bumps (not shown).

The operations of the paper roll fixing device 4 are similar to those of the paper roll fixing device 2, and are not redundantly described herein.

From the above embodiments, it is understood that the arrangements of the first supporting protrusion part, the second supporting protrusion part, the first auxiliary rollers and the second auxiliary rollers allow the paper roll fixing device of the present invention to be used with a variety of paper rolls with different diameters.

From the above descriptions, the present invention provides a paper roll fixing device of a printer. In the paper roll fixing device of the present invention, it is not necessary to install the supporting protrusion part with plural ring-shaped structures matching all paper roll specifications. On the other hand, the paper roll fixing device of the present invention is equipped with a supporting protrusion part matching the minimum diameter of the hollow shaft of the paper roll among all commercially available paper rolls. The supporting protrusion part and the auxiliary rollers below the supporting protrusion part cooperate with each other to achieve the purpose of supporting a variety of paper rolls with different diameters. As a consequence, the paper roll fixing device of the present invention has a simplified structure, reduced fabricating cost and reduced volume. Moreover, since the selection of the paper roll is no longer dependent on the supporting protrusion part, the use of the paper roll fixing device of the present invention is more convenient in order to eliminate the drawbacks of the conventional paper roll fixing device.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A paper roll fixing device of a printer for fixing a paper roll within said printer, said paper roll having a hollow shaft, said paper roll fixing device comprising:

a first supporting member comprising a first supporting protrusion part and plural first auxiliary rollers, wherein said plural first auxiliary rollers are discretely arranged near a bottom edge of said first supporting member and located below said first supporting protrusion part, wherein said first supporting member further comprises a first bottom plate, wherein said first bottom plate is vertically extended from a bottom edge of a first inner surface of said first supporting member, and said plural first auxiliary rollers are discretely arranged on said first bottom plate, wherein said first supporting protrusion part is protruded from said first inner surface and comprises a first bump and a second bump, and said first bump is disposed over said second bump, wherein said first supporting member further comprises:

a first through-hole formed in said first supporting member;

a first shaft disposed on a first outer surface of said first supporting member;

a first fixing slab pivotally coupled with said first shaft, and disposed within said first through-hole;

a first elastic element located over said first shaft and connected with a first end of said first fixing slab, wherein said first bump is disposed on said first fixing slab, and said second bump is disposed on said first propping sheet, wherein through said first elastic element, said first bump on said first fixing slab is not protruded outside said first inner surface of said first supporting member, but a second end of said first fixing slab is protruded outside said first inner surface of said first supporting member;

a second supporting member parallel with said first supporting member, and comprising a second supporting protrusion part and plural second auxiliary rollers, wherein said plural second auxiliary rollers are discretely arranged near a bottom edge of said second supporting member and located below said second supporting protrusion part, wherein said second supporting member further comprises a second bottom plate, wherein said second bottom plate is vertically extended from a bottom edge of a second inner surface of said second supporting member, and said plural second auxiliary rollers are discretely arranged on said second bottom plate, wherein said second supporting protrusion part is protruded from said second inner surface and comprises a third bump and a fourth bump, and said third bump is disposed over said fourth bump, wherein said first supporting protrusion part is inserted into said hollow shaft from a first end of said paper roll, and said second supporting protrusion part is inserted into said hollow shaft from a second end of said paper roll, so that said paper roll is fixed within a space between said first supporting member and said second supporting member, wherein said plural first auxiliary rollers and said plural second auxiliary rollers are pressed by two ends of an outer surface of said paper roll, respectively;

a rotating wheel;

a first movable track connected with said first supporting member, and engaged with said rotating wheel; and a second movable track parallel with said first movable track, connected with said second supporting member, and engaged with said rotating wheel, wherein said first movable track and said second movable track are linearly moved back and forth in a reciprocating manner through said rotating wheel, so that a distance between said first supporting member and said second supporting member is adjustable.

2. The paper roll fixing device according to claim 1, wherein said second supporting member further comprises:

a second through-hole formed in said second supporting member;

a second shaft disposed on a second outer surface of said second supporting member;

a second fixing slab pivotally coupled with said second shaft, and disposed within said second through-hole;

a second elastic element located over said second shaft and connected with a first end of said second fixing slab; and a second propping sheet disposed within said second through-hole and located under said second fixing slab, wherein said third bump is disposed on said second fixing slab, and said fourth bump is disposed on said second propping sheet, wherein through said second elastic element, said third bump on said second fixing slab is not protruded outside said second inner surface of said second supporting member, but a second end of said second fixing slab is protruded outside said second inner surface of said second supporting member.

3. The paper roll fixing device according to claim 2, wherein said first propping sheet and said second propping sheet are made of flexible materials.

4. The paper roll fixing device according to claim 3, wherein each of said second bump and said fourth bump comprises two slant surfaces for guiding said paper roll to be introduced into or removed from said space between said first supporting member and said second supporting member.

5. The paper roll fixing device according to claim 1, wherein both of said first supporting protrusion part and said second supporting protrusion part are ring-shaped bumps or cylindrical bumps.

6. The paper roll fixing device according to claim 1, wherein said first supporting member further comprises a perforation and a locking member, wherein said printer further comprises plural second toothed structures therein, and said locking member is disposed within said perforation and has plural first toothed structures, wherein said plural first toothed structures and said plural second toothed structures are engaged with each other for fixing said first supporting member.

7. A paper roll fixing device of a printer for fixing a paper roll within said printer, said paper roll having a hollow shaft, said paper roll fixing device comprising:

a first supporting member comprising a first supporting protrusion part and plural first auxiliary rollers, wherein said plural first auxiliary rollers are discretely arranged near a bottom edge of said first supporting member and located below said first supporting protrusion part, wherein said first supporting member further comprises a perforation and a locking member, wherein said printer further comprises plural second toothed structures therein, and said locking member is disposed within said perforation and has plural first toothed structures, wherein said plural first toothed structures and said plural second toothed structures are engaged with each other for fixing said first supporting member; and a second supporting member parallel with said first supporting member, and comprising a second supporting protrusion part and plural second auxiliary rollers, wherein said plural second auxiliary rollers are discretely arranged near a bottom edge of said second supporting member and located below said second supporting protrusion part, wherein said first supporting protrusion part is inserted into said hollow shaft from a first end of said paper roll, and said second supporting protrusion part is inserted into said hollow shaft from a second end of said paper roll, so that said paper roll is fixed within a space between said first supporting member and said second supporting member, wherein said plural first auxiliary rollers and said plural second auxiliary rollers are pressed by two ends of an outer surface of said paper roll, respectively.

* * * * *